US005172734A

United States Patent [19]

Matsui et al.

[11] Patent Number: 5,172,734

[45] Date of Patent: Dec. 22, 1992

[54] WEFT YARN SUPPLY DEVICE WITH BREAK TREND MONITORING APPARATUS

[75] Inventors: Isamu Matsui; Yasuo Akiyama, both of Kyoto, Japan

[73] Assignee: Murata Kikai Kabushiki Kaisha, Kyoto, Japan

[21] Appl. No.: 755,743

[22] Filed: Sep. 6, 1991

Related U.S. Application Data

[62] Division of Ser. No. 668,925, Mar. 13, 1991.

[30] Foreign Application Priority Data

Mar. 17, 1990 [JP] Japan ..... 2-67682
Jul. 25, 1990 [JP] Japan ..... 2-194869

[51] Int. Cl.[5] ..... D03D 47/34

[52] U.S. Cl. ..... 139/450; 177/25.11; 139/452

[58] Field of Search ..... 139/450, 452; 242/128, 242/54 R, 36; 177/25.11, 59

[56] References Cited

U.S. PATENT DOCUMENTS 3,700,051 10/1972 Brouwer et al. ..... 177/59
4,792,101 12/1988 Van Bogaert et al. ..... 139/450
4,887,649 12/1989 van Mullekom ..... 139/452
5,050,648 9/1961 Pezzoli ..... 139/452 X

*Primary Examiner*—Andrew M. Falik
*Attorney, Agent, or Firm*—Spensley Horn Jubas & Lubitz

[57] ABSTRACT

A weft breaks monitoring system in a loom which examines the trend of the weft break, and comprises a device for measuring a winding diameter of a weft feed package and a tension meter for detecting a weft break, wherein the winding diameter is divided into plural sections and the number of times of weft break detections from the tension meter is counted every section. A yarn release device for the weft feed package which provides an adequate tension in response to a variation of a release tension resulting from a change in the winding diameter is also provided.

4 Claims, 3 Drawing Sheets

WEFT YARN SUPPLY DEVICE WITH BREAK TREND MONITORING APPARATUS

This is a division of application Ser. No. 07/668,925, filed on Mar. 13, 1991 pending.

FIELD OF THE INVENTION

This invention relates, in a weft supply section of a shuttleless loom of a water jet room type or an air jet room type, to a system for monitoring a break of a weft yarn and a yarn release device for a package.

RELATED ART STATEMENT

Supplying of the weft yarn in the shuttleless loom is attained by supplying the weft yarn drawn out of a feed package to a water or air jet nozzle, and feeding the weft yarn to a shed opening of the warp yarn along with jetting water or air.

Such a shuttleless loom is not provided with means for examining the cause of break of the weft yarn to be supplied.

Since the conventional shuttleless loom is not provided with the means for closely examining into the cause why the weft yarn is broken during being supplied, there arises a problem in that one cannot determine what causes the break, and in addition, no measure can be taken thereagainst.

OBJECT AND SUMMARY OF THE INVENTION

It is an object of this invention to provide a weft break monitoring system in a loom which can examine the trend of the weft break, in other words, which can obtain data, based on which measures for preventing the weft break are taken.

It is another object of this invention to provide a yarn release device for a package which can provide an adequate tension in response to a variation of a release tension resulting from a change in diameter of winding.

For achieving the aforesaid object, a weft break monitoring system in a loom according to this invention comprises a device for directly or indirectly measuring a winding diameter of a weft feed package, and a tension meter for detecting a weft break, wherein the winding diameter of the weft feed package is divided into plural sections, and the number of times of weft break detections from the tension meter is counted for every section.

In the weft break monitoring system in a loom as configured above, when the weft yarn is broken, such a break is detected by the tension meter, and the number of times of break detections is counted for every section of the winding diameter of the weft feed package.

The present invention further provides a device comprising an element monitoring means for continuously monitoring elements representative of a variation of release tension, and a balloon-length control means for adjusting a balloon length to minimize said tension on the basis of information from said element monitoring means.

With the aforementioned arrangement, the element monitoring means detects a winding diameter of a feed package, or detects a tension of yarn to permit said detected value input into the balloon-length control means. The balloon length control means causes the balloon length to be increased or decreased so as to provide the minimal release tension using said detected value.

One advantage of this embodiment of the present invention is that because the system comprises an element monitoring means for continuously monitoring elements representative of variations in release tension and balloon-length control means for adjusting the balloon length to minimize tension on the basis of information from the element monitoring means, the minimum release tension may be maintained as the yarn release progresses, even when the diameter of the feed package becomes small.

DETAILED DESCRIPTION OF PREFERRED EMBODIMENT

Three embodiments of the weft break monitoring system in a loom according to this invention will be described hereinafter with reference to the drawings.

(1) The system for recording the relationship between the diameter of the weft feed package and the weft break will be described with reference to FIG. 1.

A weft feed package P is supported on a peg 2 secured to a creel 1. A weft yarn Y released from the package P passes through a guide G, passes through a clamp member and a water or air jet nozzle not shown and is delivered into a shed opening of the warp from the jet nozzle. The jetted weft yarn Y is cut at its opposite ends by a cutter for forming woven fabric having a predetermined width.

A tension meter 3 is installed directly behind the guide G so as to detect the break of the weft yarn Y.

A winding-diameter detecting photosensor 4 is provided on the peg 2. The photosensor 4 comprises a plurality of semiconductor system or photoconductive type elements arranged in a diametral direction of the package P. Light is emitted from each element toward the end of the package P, and each element receives light reflected therefrom.

Figure 1:
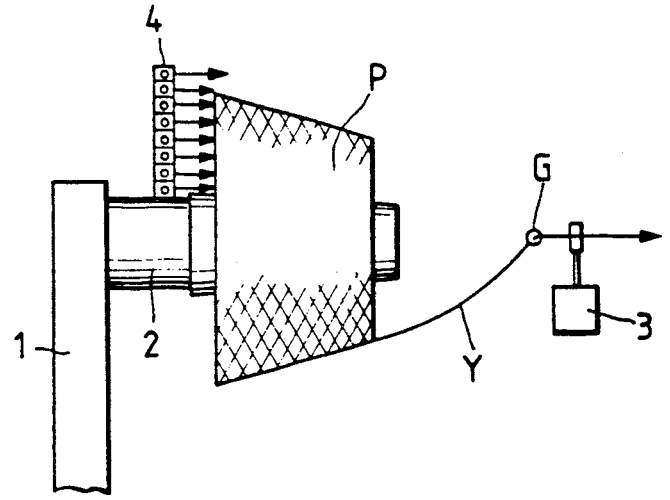
FIG. 1 is a front view of a system for recording the relationship between a diameter of a weft feed package and a weft break.

In FIG. 1, eight elements are arranged, and the light from the uppermost element does not impinge upon the end of the package P but goes straight on whereas light from other elements impinge upon the end of the package P and receive light reflected therefrom. Thereby, the fact that the diameter of the package P corresponds to seven elements is electrically detected.

Further, the number of times of weft break detections from the tension meter 3 corresponding to the number of elements which receive the reflected light is counted.

Figure 4:
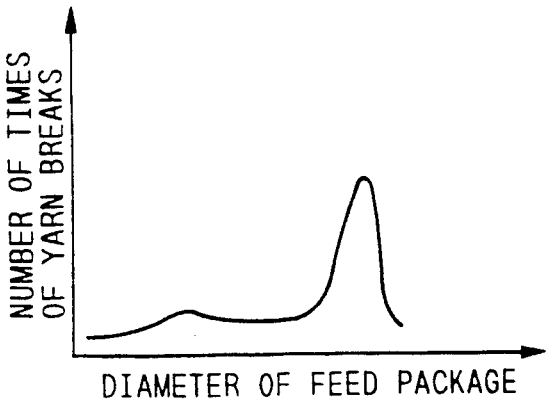
FIG. 4 is a view showing the relationship between the number of times of weft breaks and the diameter of the weft feed package.

This is graphically shown and automatically written in FIG. 4.

(2) The system will be described with reference to FIG. 2, in which the weight of the weft feed package is measured, and the measured result is converted into the diameter of the weft feed package, and the relation thereof with the number of times of weft breaks is examined.

The same members as those shown in FIG. 1 are indicated by the same reference numerals, and repeated explanation will be omitted.

A load cell 5 is installed on the creel 1 through a support member. The weft feed package P supported on the peg 2 is placed on the load cell 5.

The load cell 5 is provided so that when a load is applied, a strain proportional to stress is produced in a strain gauge, and an electric resistance is varied, and a current flowing therethrough is varied to thereby detect the load.

The range of the current of the load cell 5 corresponding to the yarn weight of the feed package P is divided into eight, for example, and the number of times of weft break detections by the tension meter 3 corresponding to the respective divisions of the current is counted.

Figure 5:
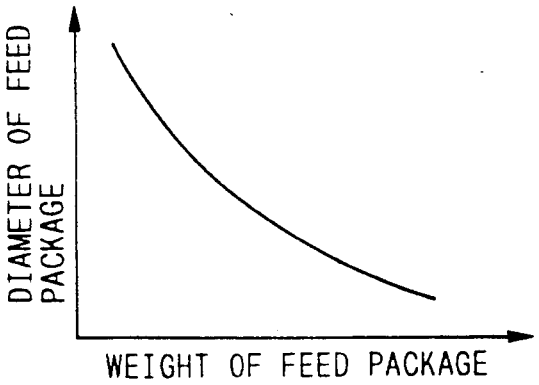
FIG. 5 is a view showing the relationship between a yarn weight of the weft feed package and a winding diameter.

There is an interrelation shown in FIG. 5 between the yarn weight and the winding diameter of the feed package P. This is corrected, and the relationship between the number of times of yarn breaks and the diameter of the feed package is graphically shown and automatically written as indicated in FIG. 4.

(3) The system will be described with reference to FIG. 3, in which the release time of the weft feed package is measured, and the measured result is converted into the diameter of the weft feed package, and the relation thereof with the number of times of the number of times of the weft breaks is examined.

The same members as those shown in FIG. 1 are indicated by the same reference numerals, and repeated explanation will be omitted.

Reference numeral 6 denotes a timer for counting the release time of the weft feed package, in other words, the operating time of the loom. More specifically, the timer is operatively connected to the drive device for the loom so that the timer does not count the time when the loom stops.

The time counted by the timer 6 is divided into eight, for example, and the number of times of weft break detections from the tension meter 3 corresponding to the respective divided time is counted.

There is present a certain interrelation between the release time of the feed package P and the winding diameter. This is corrected, and the relationship between the number of yarn breaks and the diameter of the feed package is graphically shown and automatically writted in FIG. 4.

Figure 6:
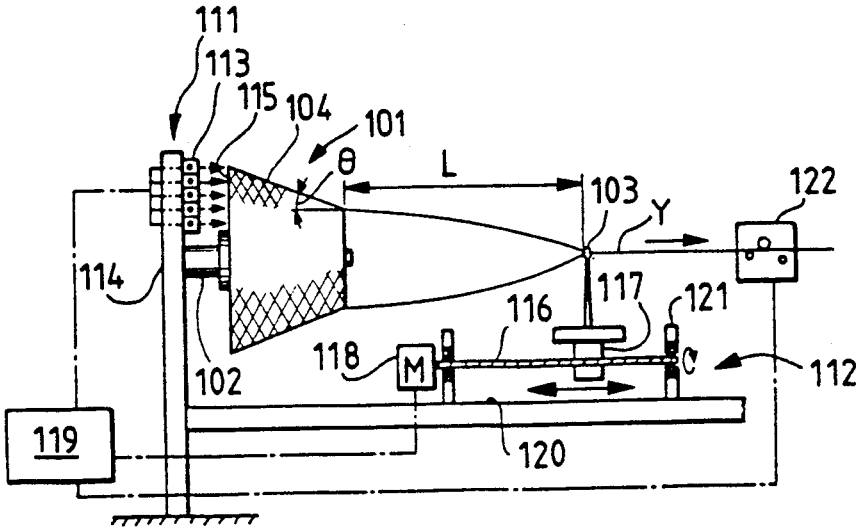
FIG. 6 is a side view showing one embodiment of a yarn release device for a package according to the present invention.

In the embodiments described above, the tension meter 3 and the means for determining winding diameter (either photosensor 4, load cell 5, or timer 6) are operably connected to a control device for counting the number of breaks in each section. The tension meter, means for determining winding diameter and control device may be connected, for example, in a manner similar to that illustrated in FIG. 6. As illustrated in FIG. 6, the control device 119 is operably connected to the tension meter 122 and the monitoring means 111.

Three embodiments have been described. Next, a description will be made of how the cause of the weft break is judged from the results obtained from these monitoring systems.

The causes of the weft breaks roughly include the cause of the loom itself, the cause of the rewinding step, and the cause prior to the rewinding step. For example, in the case where the yarn is cut at random irrespective of the diameter of the feed package, it is judged that the cause would have been resulted from the loom. Further, as shown in FIG. 4, if a peak of weft break is present in the vicinity of the maximum diameter of the feed package P, there is a problem in a portion of a ribbon diameter. In this case, it is judged that the cause would have been resulted from the winder.

Some of these judgements are based on a presumption, but they become more positive as data are accumulated.

It is to be noted that if, in addition to these measurements, the release tension of the weft feed package P is measured simultaneously, various other causes of weft breaks can be closely examined.

This invention is configured as described above, and has the effects as follows.

The relationship between the relationship between the diameter of the weft feed package and the weft break can be examined by a simple monitoring system. The trend of the weft break is carefully examined whereby what cause brings forth the break can be known. Therefore, the measures can be taken thereagainst.

Figure 2:
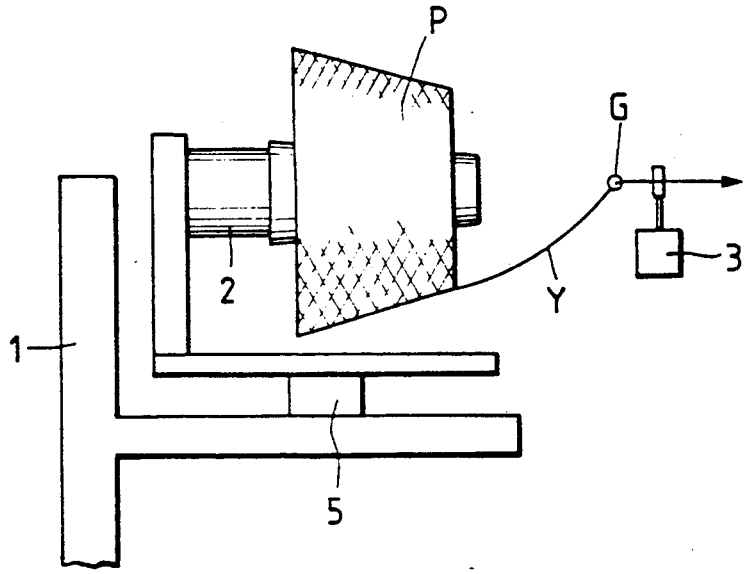
FIG. 2 is a front view of a system in which a weight of a weft feed package is measured, and the measured result is converted into the diameter of the weft feed package, and the relationship thereof with the number of times of weft breaks is examined.
Figure 3:
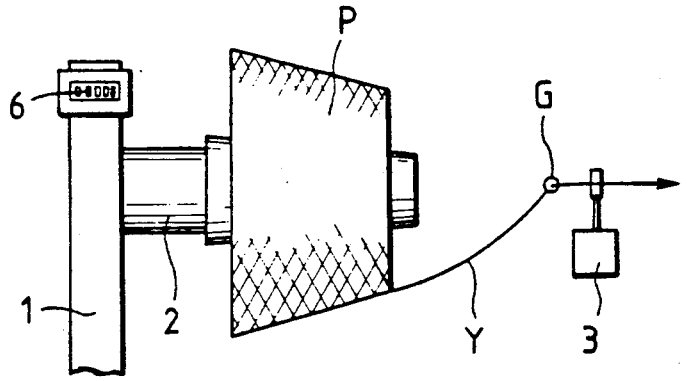
FIG. 3 is a front view of a system in which the release time of a weft feed package is measured, and the measured result is converted into a diameter of the weft feed package, and the relationship thereof with the number of times of weft breaks is examined.

Next, a device for controlling a variation of a release tension when a yarn is released from the package as shown in FIGS. 1 to 3, will be illustrated.

Figure 8:
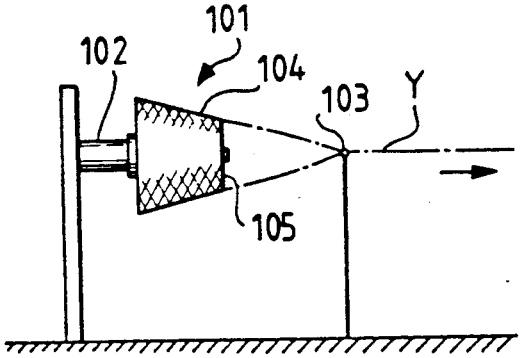
FIG. 8 PRIOR ART
FIG. 8 is a side view showing a conventional yarn release device for a package.

As shown in FIG. 8, a yarn release device for a package provided on a mechanism for supplying yarn to a loom or the like has a holder 102 for supporting a feed package 101 so that a shaft thereof is horizontal, and a guide eye 103 for guiding a yarn Y drawn out of the package 101, wherein the yarn is successively released from a yarn layer 104 of the package 101, and the yarn is axially drawn out.

In the above-described conventional yarn release device, the distance from a release side end of the feed package 101 (a small-diameter side end in case of a cone type package) 105 to the guide eye 103 is fixed to an experimental value (for example, in the range of 300 mm to 500 mm) in consideration of synthetic releasability. That is, the length of balloon has been substantially constant.

However, the yarn tension at the time of release varies with the winding diameter of the feed package 101 being released, and is not always constant.

For this reason, in the past, there was a problem in that when the package 101 is released at high speed, the release tension increases, and a yarn break occurs.

In view of the foregoing, the fourth embodiment of the present invention has been accomplished. The embodiment provides a device comprising an element monitoring means for continuously monitoring elements representative of a variation of release tension, and a balloon-length control means for adjusting a balloon length to minimize said tension on the basis of information from said element monitoring means.

FIG. 6 shows an embodiment of a yarn release device for a package. In FIG. 6, components similar to those of prior art shown in FIG. 8 are indicated by the same reference numerals, explanation of which will be omitted.

This yarn release device principally comprises an element monitoring means 111 for continuously monitoring elements representative of a variation of release tension T, and a balloon-length control means 112 for adjusting a balloon length L to minimize said tension on the basis of information from said element monitoring means.

In the present embodiment, as an element representative of a variation of tension, a winding diameter $\phi$ of a feed package 101 is used, and as an element monitoring means 111, a plurality of photosensors 113 are used. These photosensors 113 are arranged on a longitudinal plate 114 supporting a holder 102 so that the photosensors are opposed close to the end 115 on the large-diameter side of the feed package 101 and radially thereof, whereby a position of an outer peripheral edge of a yarn layer 104 can be detected to measure the winding diameter $\phi$ (outer diameter).

The balloon-length control means 112 is provided below on the small diameter side of the feed package 101, and principally comprises a threaded rod (bowl screw) 116 extended in parallel in an axial direction (in a direction for drawing the yarn) of the feed package 101, a movable block 117 threadedly engaged with the threaded rod 116, a step motor 118 for rotating the threaded rod 116, and a controller 119 for suitably driving the step motor 118. The threaded rod 116 is supported at opposite ends on bearing members 121 stood upright on a horizontal place plate 120, one end thereof being connected to an output shaft of the step motor 118.

A guide eye 103 is mounted on the movable block 117 so that when the threaded rod 116 is rotated, the guide eye 103 moves in an extending direction of the threaded rod 116. That is, the balloon length L is varied when the step motor 118 is driven.

The controller 119 calculates a balloon length $L_o$ most suitable for the winding diameter $\phi$ at that time on the basis of the value detected by the photosensors 113 and drive the step motor 118 so as to assume the balloon length $L_o$.

The release tension T of the yarn Y tends to be small when the winding diameter $\phi$ is large and to be larger when the winding diameter $\phi$ is small. The relationship between the balloon length L and the release tension T is that the longer the balloon length L, the larger the tension T, and the shorter the balloon length L, the tension T is small. Accordingly, if the balloon length L is suitably made short as the winding diameter $\phi$ becomes small, the optimum (minimum) release tension $T_o$ can be obtained.

Figure 7:
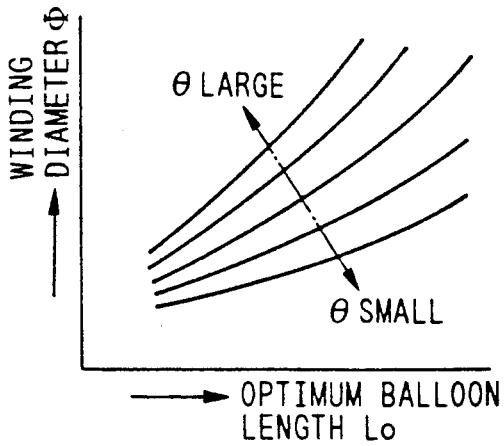
FIG. 7 is a view showing the relationship between a winding diameter of a package and an optimum balloon length for explanation of the operation thereof.

In other words, the winding diameter $\phi$ of the package 101 and the optimum balloon length $L_o$ by which the release tension T is made smallest are in the positive interrelation therebetween, as shown in FIG. 7. This relationship of FIG. 7 is stored in the controller 119 as data obtained experimentally in advance.

Further, in the present embodiment, the interrelation between the winding diameter $\phi$ of the package 101 and the optimum balloon length $L_o$ is obtained every angle of inclination $\theta$ with respect to the axis of the yarn layer 104, as shown in FIG. 7. With respect to this angle of inclination $\theta$, in case of the cone type package as shown in FIG. 6 and the same winding diameter $\phi$, the larger the angle of inclination $\theta$, the optimum balloon length $L_o$ tends to become small.

Moreover, in the present invention, a tension meter 122 is provided downstream away from the guide eye 103 so that the tension of the drawn yarn Y can be directly measured. The resulting measured value is input into the controller 119 to make sure if the value is a calculated value. When the value is considerably deviated, this value is recorded as a unique point along with the winding diameter $\phi$ at that time. This unique point is considered to have resulted from a defect such as a ribbon winding produced in the production step (automatic winder) of the package 101.

The operation of the present embodiment will be described hereinafter.

In releasing the feed package 101, the angle of inclination $\theta$ is first input into the controller 119 to extract the interrelation between the winding diameter of the package 101 and the optimum balloon length $L_o$. Then, the guide eye 103 is positioned so as to have the initial balloon length L corresponding to the predetermined winding diameter (full package) $\phi$.

When the release starts, the winding diameter $\phi$ of the package gradually becomes small, and the photosensors 113 continuously detect it. The photosensors input the detected value into the controller 119. The controller 119 calculates the optimum balloon length $L_o$ in accordance with the interrelation as shown in FIG. 7, and the step motor 118 is caused to drive to rotate the threaded rod 116 around the axis. This rotation moves the movable block 117 and the guide eye 103 toward the feed package 101 to reduce the balloon length L to provide the optimum balloon length $L_o$. Thus, the release tension T is always maintained at the minimum value $T_o$.

When the release proceeds so that the yarn Y of the feed package 101 disappears, a next new feed package 101 is set, and the guide eye 103 is positioned so as to provide again the initial balloon length L according to the winding diameter $\phi$, after which the balloon length L is controlled in a manner similar to that as described above.

As described above, the photosensors 113 for detecting the winding diameter $\phi$ of the feed package 101 and the balloon length control means 112 for moving the guide eye 103 on the basis of information therefrom are provided. Therefore, even if the winding diameter $\phi$ of the feed package 101 becomes small as the yarn release proceeds, the minimum release tension $T_o$ always exists to prevent occurrence of generation of yarn break.

Since many photosensors 113 are provided in a diametral direction, continuous positive balloon-length control can be carried out.

Furthermore, in the present embodiment, since the tension T of the drawn yarn Y is measured by the tension meter 122, a defect of the feed package 101 can be found by the detected value to contribute to overcoming defect in the production step.

It is to be noted that the more photosensors 113 shown in FIG. 6, the winding diameter $\phi$ can be positively detected to render fine control possible.

Various elements representative of variation of the release tension and element monitoring means other than those shown in the embodiment are considered. For example, a package weight is selected as an element and a weight sensor is provided on the holder or the like so that information of weight variation obtained as the release proceeds may be input into the controller. In this case, the interrelation between the package weight and the optimum balloon length or the relationship between the weight and the package diameter is obtained to indirectly obtain the interrelation with the optimum balloon length and input and set it in the controller.

Alternatively, the time from the start of the release is measured, which is input into the controller, and the balloon length may be controlled from the relationship between the passage time and the optimum balloon length.

Furthermore, the tension meter shown in FIG. 6 is used as the element monitoring means so that the feedback controlled is made to minimize the detected value. For example, the tension value at that time is compared with the tension value directly prior thereto. When the tension value becomes large, the guide eye is moved to look for a position at which the tension value is minimum. Such an arrangement eliminates photosensors or the like whereby control of the balloon length may be carried out in a simple structure.

On the other hand, the balloon-length control means is not limited to that shown in the aforementioned embodiment. For example, a timing belt may be used in place of the bowl screw, or an induction motor which is a motor with a position sensor may be used in place of the step motor.

While in the aforementioned embodiment, the feed package is released in the state where the shaft is horizontal, it is to be noted that the present invention can be applied even in the case where the shaft is vertical.

Even the feed package is of a cheese type, the present invention can be likewise applied.

What is claimed is:

1. A system for monitoring yarn breaks as a yarn is unwound from a weft feed package, the weft feed package defining a plurality of radially extending sections, the system comprising:

sensor means for sensing a winding diameter of the weft feed package;

tension detector means for detecting a weft break during unwinding; and control means, operably connected to the sensing means and the tension detector means, for counting a number of yarn breaks in at least one of the sections.

2. The system of claim 1, wherein the sensor means for sensing a winding diameter comprises a photosensor.

3. The system of claim 1, wherein the weft feed package defines a weight and the sensor means for sensing a winding diameter comprises a load cell for measuring the weight of the weft feed package.

4. The system of claim 1, wherein the sensor means for sensing a winding diameter comprises a timer for counting a release time of the weft feed package.

* * * * *